United States Patent [19]

Gish

[11] Patent Number: 5,039,149

[45] Date of Patent: Aug. 13, 1991

[54] ANIMAL FECES GATHERING AND DISPOSAL APPARATUS

[76] Inventor: Donald A. Gish, 3737 Lone Tree Way, Antioch, Calif. 94509

[21] Appl. No.: 493,757

[22] Filed: Mar. 15, 1990

[51] Int. Cl.[5] ..... A01K 29/00; E01H 1/12

[52] U.S. Cl. ..... 294/1.4; 15/104.8; 15/257.1; 294/55

[58] Field of Search ..... 294/1.1, 1.3–1.5, 294/19.1, 53.5, 55, 99.1; 15/104.8, 257.1, 257.2, 257.4, 257.6, 257.7; 248/99–101

[56] References Cited

U.S. PATENT DOCUMENTS

| | | | |
|---|---|---|---|
| 3,703,158 | 11/1972 | Lemler | 294/1.3 |
| 3,827,098 | 8/1974 | Sanderson | 294/1.4 |
| 3,868,135 | 2/1975 | Magliaro | 15/257.6 X |
| 3,942,831 | 3/1976 | Sosnove | 15/257.4 X |
| 4,019,768 | 4/1977 | Niece | 294/1.3 |
| 4,097,082 | 6/1978 | Orofino | 294/1.4 |
| 4,221,415 | 9/1980 | Ganz | 294/1.4 |
| 4,537,377 | 8/1985 | Shewchuk | 248/99 |

FOREIGN PATENT DOCUMENTS

| | | | |
|---|---|---|---|
| 916849 | 8/1954 | Fed. Rep. of Germany | 15/257.1 |
| 2704177 | 8/1978 | Fed. Rep. of Germany | 294/1.4 |
| 3325696 | 1/1985 | Fed. Rep. of Germany | 294/1.4 |

*Primary Examiner*—Johnny D. Cherry
*Attorney, Agent, or Firm*—Linval B. Castle

[57] ABSTRACT

A scoop for the collection and disposal of animal feces includes a rectangular metal sheet formed into a "V" with a pivoting elongated handle on a top leg of the "V" and a resilient member connected to one interior surface of the top leg and contacting the interior of the lower leg for grasping the closed end of a plastic bag, the open end of which is brought out and around the "V" and secured to a rubber disc by either a clip on a cord or, if plastic grocery or merchandise bags are used, by the handles on the bags. The bags can readily be removed, tied closed, and disposed of without danger of physical contact with the contents.

7 Claims, 2 Drawing Sheets

FIG. 2
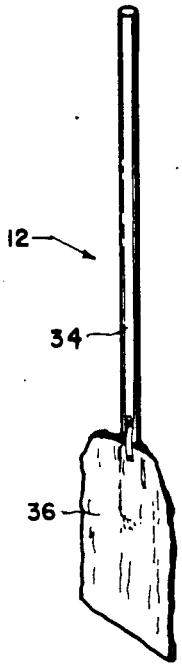
FIG. 1
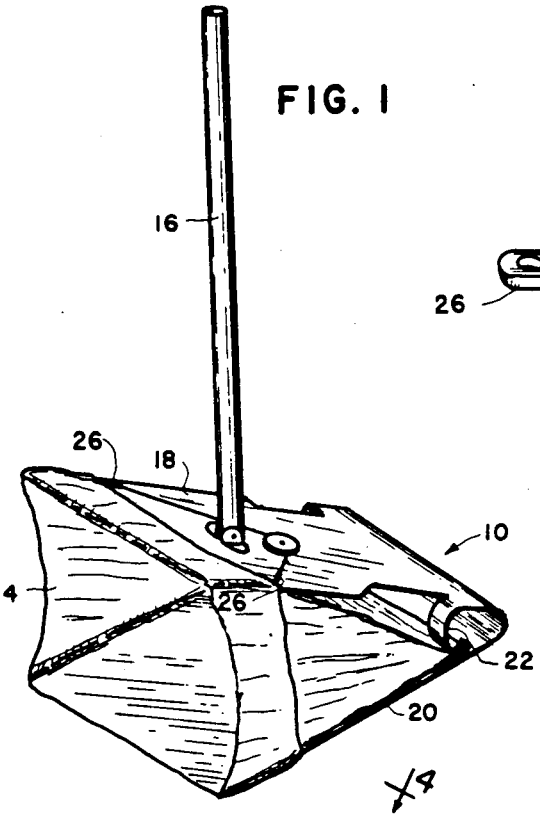
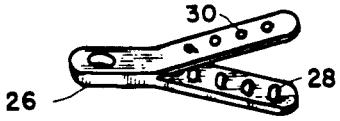
FIG. 7
FIG. 3
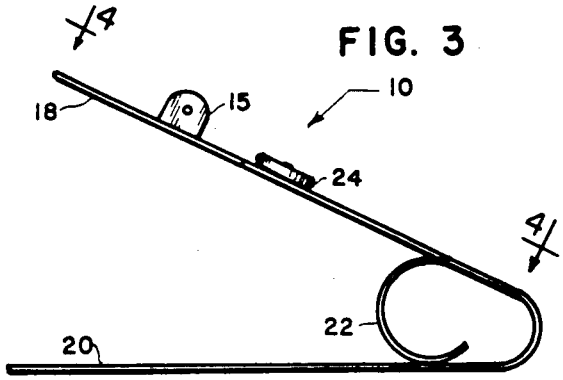
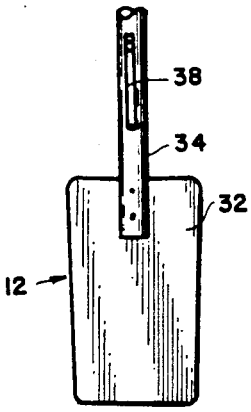
FIG. 5
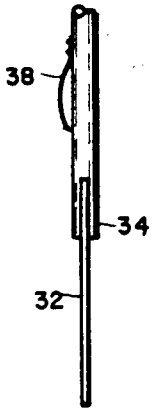
FIG. 6
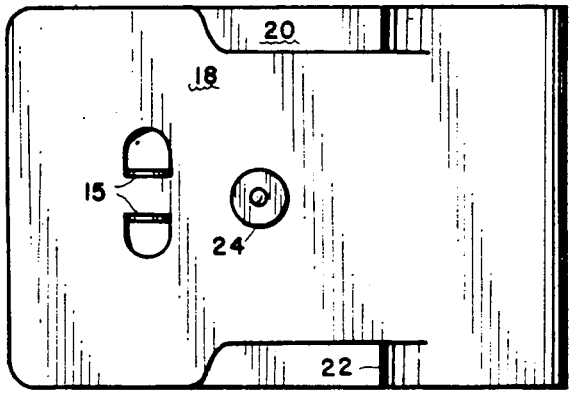
FIG. 4

ANIMAL FECES GATHERING AND DISPOSAL APPARATUS

BRIEF SUMMARY OF THE INVENTION

This invention relates to animal feces scoops and disposal devices and in particular to a simple long handled "dust pan" type of device for supporting a disposable plastic bag into which animal feces may be guided and which may be secured and disposed of without danger of physically contacting the bag contents.

Most urban areas of the country have leash laws requiring owners of dogs to keep their pets in a fenced yard or on a leash. Many of these urban areas also require a pet owner to remove any feces that their animal may have left unburied on a sidewalk or in a neighbor's yard.

Several types of so-called scoopers have been developed and marketed for gathering animal feces for later disposal. The apparatus to be described herein is a very simple and inexpensive form of long-handled scoop which supports and clamps a plastic bag which covers the interior surface of the apparatus and partially covers the exterior surface and which, after use, may be easily removed from the apparatus, tied and disposed of without any danger of contacting the contents of the bag.

Briefly described, the apparatus includes a thin V-shaped member, one leg of which forms a bottom plate, the other leg forming a top plate. Near the apex of the member, and secured only to the inner surface of the top plate, is a spring or resilient pad so that the closed end of a plastic bag may be wedged between the spring and the bottom plate and so that the open end of the bag may be brought out and around the opening in the "V" to form a plastic inner lining for the member, the lining being easily removed, tied and disposed of without contact with the contents of the bag.

BRIEF DESCRIPTION OF THE DRAWINGS

In the drawings which illustrate preferred embodiments of the invention:

FIG. 1 is a perspective view of an animal feces disposal apparatus illustrating the installation of a plastic bag;

FIG. 2 is a perspective view of a plastic bag covered paddle for sweeping animal feces into the plastic bag in the disposal apparatus;

FIG. 3 is a side elevational view of the disposal apparatus of FIG. 1;

FIG. 4 is a plan view taken along the lines 4—4 of FIG. 3;

FIG. 5 is a front elevational view of a portion of the paddle of FIG. 2;

FIG. 6 is a side elevational view of the paddle of FIG. 5;

FIG. 7 is a perspective view of a "peg-and-hole" clip for coupling an end of a bag holding cord to a plastic bag;

DETAILED DESCRIPTION OF THE PREFERRED EMBODIMENT

Figure 8:
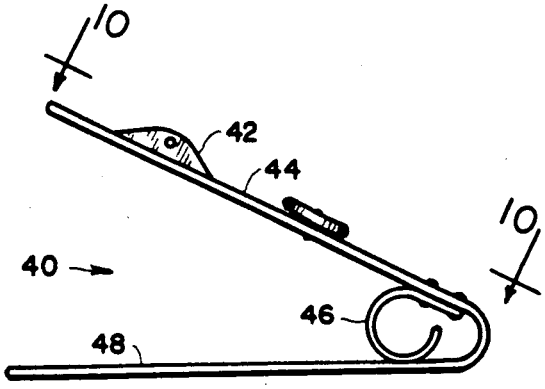
FIG. 8 is a side view of an alternate embodiment of a disposal apparatus with the bag holding member riveted to the apparatus.

FIGS. 1 and 2 are views illustrating the typical positioning of the disposal apparatus 10 and an associated paddle 12 for sweeping animal feces into a plastic bag 14 attached to the apparatus 10.

The disposal apparatus 10, which is best illustrated in FIGS. 3 and 4, is formed of a single flat sheet of material, such as a sheet of aluminum, approximately eight inches in width and two feet in length. The flat sheet is punched to form a one-inch wide by four inch long ribbon along each of the long sides of the metal about four inches from one end and also a pair of spaced semicircular cuts near the center of the sheet about three inches from the same end. The metal resulting from these cuts is bent at an angle normal to the sheet surface to form a pair of brackets 15 for pivotally riveting one end of a tubular handle 16 about 26 inches in length.

The flat metal sheet is then bent into an approximate 25° V-shape across its center on an approximate one-half inch radius to form a connected upper plate 18 and lower plate 20, the upper plate having the outwardly extending handle brackets 15 and the one-inch wide edge cuts. The one-inch wide ribbons resulting from the edge cuts remain attached to the metal sheet near the central bend and these ribbons are bent down in a circular pattern to contact the lower plate 20 to thereby form a resilient member 22 for securing between the plate 20 and member 22 the closed end of a plastic bag. Finally, a rubber or resilient plastic disc 24 about 1½ inches in diameter and with a beveled edge is riveted to the top surface of the upper plate 18 for securing the open end of a plastic bag, as best shown in FIG. 1.

FIG. 1 illustrates the disposal apparatus with an installed plastic bag 14. The closed or bottom end of the plastic bag is inserted between the resilient member 22 and the floor of the lower plate 20 and the open end of the bag is brought out of the "V" opening and folded back over the top surface of the upper plate 18 and also the bottom surface of the lower plate 20. If a conventional grocery or merchandise type of thin plastic bag with integral handles is used, the handles brought up along each side of the "V" of the apparatus 10 may be hooked over the disc 24 to secure the bag. If plain bags without handles are employed, the bags may be secured with a cord 26 wrapped around the disc 24 and with its ends connected to a "peg and hole" connector 26 such as shown in FIG. 7. In such a connector, the thin plastic of the bag is inserted between the blades containing the pegs 28 and the aligned holes 30 and the blades, when pressed together, will tightly secure the plastic.

The disposal apparatus described above is most conveniently used with a paddle that can be used to brush feces into the plastic bag 14. FIGS. 2, 5 and 6 illustrate such a paddle that may be formed of metal blade 32 with attached tubular shaft 34 or which may be formed entirely of plastic. To avoid the need to wash dirt that may have dried on the paddle, it is preferably covered with a small plastic bag 36 which may be disposed of along with the bag 14 after it has served its function. To secure a bag to the paddle blade 32, a resilient clip 38 is riveted to the shaft, as illustrated. The bag is installed by merely lifting the clip 38 and inserting an open end of the bag under the clip which then supports the bag between the end of the clip and the shaft.

After use of the disposal apparatus, the paddle bag 36 may be removed, placed in the disposal bag 14 and the disposal bag removed from the apparatus 10 and knotted closed and placed in the garbage.

FIGS. 8-11 illustrate slightly different embodiments of the animal feces gathering and disposal apparatus, all embodiments being fundamentally identical.

FIG. 8 is a side view of a disposal apparatus 40 which is preferably formed of plastic but with a metal handle bracket 42 riveted to the top surface of the upper plate 44 and a circular coil spring 46 riveted to the top plate and in contact with the top surface of the lower plate 48. The operation of this embodiment is identical with that of the embodiment shown in FIG. 1.

Figure 10:
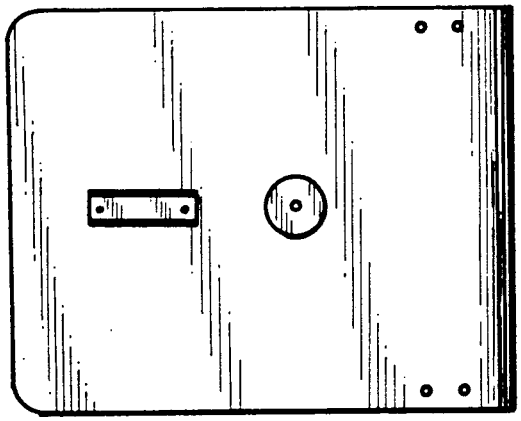
FIG. 10 is a plan view of the embodiments illustrated in FIGS. 8 and 9.

FIG. 10 is a top plan view taken along the lines 10—10 of FIG. 8.

Figure 9:
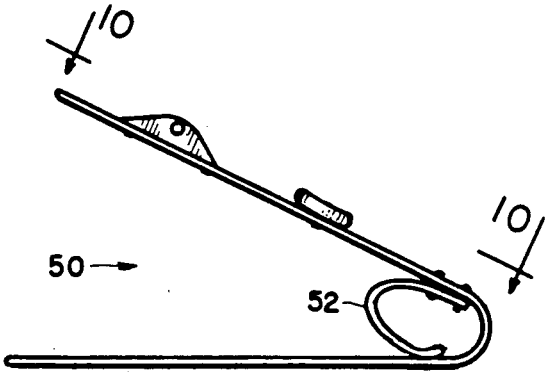
FIG. 9 is a side view of still another embodiment of a disposal apparatus using an easy-loading, difficult-removal bag holding member.

FIG. 9 is the side view of still another embodiment of a disposal apparatus made substantially identically to that of FIG. 8 but preferably formed of a resilient tempered aluminum V-shaped body 50 but with a pliable bag securing member 52 that is riveted at one end to the top plate and which may be manually bent to a desired shape. The member 52, as illustrated, is bent at an angle of contact with the lower plate so that a plastic bag may be easily inserted into the small acute angle formed between the member and lower plate but, because of a larger removal angle, will resist easy removal of the bag.

FIG. 10 also applies to FIG. 9 and shows a top plan view taken along the lines 10—10 of FIG. 9.

Figure 11:
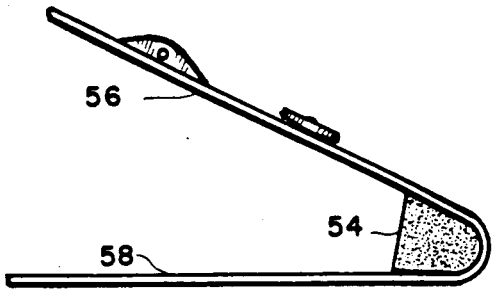
FIG. 11 is a side view of yet another embodiment of a disposal apparatus using a resilient sponge as a bag holding member.

In FIG. 11 the metal bag securing member shown in FIGS. 1-9 has been replaced with a resilient sponge material 54 that is cemented only to the upper plate 56 and which conforms generally to the arcuate surface between the upper and lower plates of the disposal apparatus. Since there is no attachment between the material 54 and the lower plate 58, a plastic bag may be secured by urging its closed end between the material 54 and the lower plate 58.

I claim:

1. A scoop for gathering and removal of animal faces from sidewalks or the like, said scoop comprising:

a single rectangular sheet of material bent on a radius substantially across the center of the sheet into a "V" shape, one leg of said "V" forming and upper plate, the second leg of said "V" forming a lower plate, each of said plates having an interior surface facing the center of said "V", and an exterior surface facing outward from said "V":

a handle bracket extending from the exterior surface of said upper plate, said means including means for pivotally connecting an elongated handle thereto;

first bag securing means attached to the interior surface of said upper plate and adjacent the bend forming said "V", said securing means resiliently contacting the interior surface of said lower plate for securing the closed end of a plastic bag within the scoop; and second bag securing means on the exterior surface of said upper plate between said bend forming said "V" and the end of said upper plate for securing an open end of a plastic bag that extends form said first bag securing means and over the ends of said upper and lower plates.

2. The scoop claimed in claim 1 wherein aid second bag securing means is a resilient disc for attachment of plastic bag handles and cords at the open end of a plastic bag.

3. The scoop claimed in claim 2 wherein said cords are attached to a plastic bag by a peg-and-hole connector having jaws for snapping over the material of a plastic bag, said peg-and-hole connector having an opening for securing a cord.

4. The scoop claimed in claim 1 wherein said rectangular sheet of material is a resilient metal and wherein said first bag securing means is formed of a ribbon of said metal cut along each side edge of said upper plate and bent in a circular pattern to contact the interior of said lower plate.

5. The scoop claimed in claim 1 wherein said rectangular sheet of material is a resilient metal and wherein said first bag securing means is a manually pliable metal strip for contacting edge portions of the interior surface of said lower plate.

6. The scoop claimed in claim 1 wherein said rectangular sheet of material is metal and wherein said first bag securing means is resilient sponge material extending across the interior of said scoop at said bend.

7. The scoop claimed in claim 1 wherein said rectangular sheet of material is plastic and wherein said firs bag securing means is a resilient metal.

* * * * *